US010426314B2

(12) United States Patent
Cantrell et al.

(10) Patent No.: US 10,426,314 B2
(45) Date of Patent: Oct. 1, 2019

(54) FLUID PUMP VOLUTE DIVERSION SYSTEM, SOLIDS COLLECTION SYSTEM AND RELATED METHODS FOR A WASHING MACHINE

(71) Applicant: Unified Brands, Inc., Jackson, MS (US)

(72) Inventors: John W. Cantrell, San Antonio, TX (US); Mark Churchill, Grain Valley, MO (US); Michael Licata, Lee's Summit, MO (US); Josh Huisenga, Kansas City, MO (US); David Gast, Lenexa, KS (US)

(73) Assignee: Unified Brands, Inc., Jackson, MS (US)

( * ) Notice: Subject to any disclaimer, the term of this patent is extended or adjusted under 35 U.S.C. 154(b) by 45 days.

(21) Appl. No.: 15/250,528

(22) Filed: Aug. 29, 2016

(65) Prior Publication Data

US 2016/0360944 A1 Dec. 15, 2016

Related U.S. Application Data

(63) Continuation of application No. 13/367,179, filed on Feb. 6, 2012, now Pat. No. 9,427,131.

(60) Provisional application No. 61/439,751, filed on Feb. 4, 2011.

(51) Int. Cl.

| | |
|---|---|
| ***A47L 15/42*** | (2006.01) |
| ***A47L 15/00*** | (2006.01) |
| *A47L 15/08* | (2006.01) |

(52) U.S. Cl.

CPC ..... *A47L 15/4202* (2013.01); *A47L 15/0078* (2013.01); *A47L 15/4208* (2013.01); *A47L 15/4219* (2013.01); *A47L 15/4225* (2013.01); *A47L 15/0076* (2013.01); *A47L 15/0092* (2013.01); *A47L 15/08* (2013.01)

(58) Field of Classification Search

CPC ..... A47L 15/4202; A47L 15/006; A47L 15/0078; A47L 15/4219; A47L 15/4221; A47L 15/4225; A47L 15/4208

See application file for complete search history.

(56) References Cited

U.S. PATENT DOCUMENTS

| | | | | |
|---|---|---|---|---|
| 3,313,311 | A * | 4/1967 | Gilson | A47L 15/16 134/10 |
| 4,773,436 | A | 9/1988 | Cantrell et al. | |
| 6,182,674 | B1 | 2/2001 | Jozwiak et al. | |
| 2003/0041886 | A1 | 3/2003 | Cantrell et al. | |

(Continued)

FOREIGN PATENT DOCUMENTS

| | | | |
|---|---|---|---|
| DE | 102014214345 B3 * | 7/2015 | D06F 39/083 |
| WO | WO/2010/040149 | 4/2010 | |

OTHER PUBLICATIONS

Machine translation of DE-102014214345-B3, dated Jul. 2015. (Year: 2015).*

(Continued)

*Primary Examiner* — Michael E Barr
*Assistant Examiner* — Kevin G Lee
(74) *Attorney, Agent, or Firm* — Kutak Rock LLP; Brian L. Main

(57) ABSTRACT

A fluid pump volute offshoot system for debris diversion and collection, a solids collection system, and related methods, for a pot and pan, or other, similar, washing machine is provided.

24 Claims, 3 Drawing Sheets

(56) References Cited

U.S. PATENT DOCUMENTS

| | | | | |
|---|---|---|---|---|
| 2003/0041887 | A1 | 3/2003 | Inch et al. | |
| 2004/0244822 | A1 | 12/2004 | Cantrell et al. | |
| 2006/0130878 | A1 | 6/2006 | Lee et al. | |
| 2006/0237049 | A1* | 10/2006 | Weaver | A47L 15/4204 134/56 D |
| 2008/0041419 | A1 | 2/2008 | Gaus | |
| 2011/0120503 | A1 | 5/2011 | Cantrell et al. | |
| 2012/0118336 | A1* | 5/2012 | Welch | A47L 15/4206 134/110 |
| 2017/0231462 | A1* | 8/2017 | Fountain | A47L 15/4202 134/10 |

OTHER PUBLICATIONS

Written Opinion of International Search Authority in PCT/US2012/024011, dated May 23, 2012.

* cited by examiner

FLUID PUMP VOLUTE DIVERSION SYSTEM, SOLIDS COLLECTION SYSTEM AND RELATED METHODS FOR A WASHING MACHINE

CROSS-REFERENCE TO RELATED APPLICATIONS

This application is a continuation application of U.S. patent application Ser. No. 13/367,179, filed Feb. 6, 2012, now U.S. Pat. No. 9,427,131, which claims priority pursuant to 35 U.S.C. 119(e) to U.S. Provisional Patent Application Ser. No. 61/439,751, filed Feb. 4, 2011, the entire disclosures of which are incorporated herein by reference.

FIELD

The present invention relates generally to improvements for a pot and pan, or other, similar, washing machine. More specifically, the present invention is concerned with a fluid pump offshoot for debris diversion and collection.

BACKGROUND

Pot and pan washing machines, of the type used in restaurants, institutions and other eating facilities often involve a large wash tank or basin in which water or other cleaning fluid is circulated to provide a continuous motion rolling wash action for the pots and pans and other "wares" (i.e. pots, pans, utensils, flatware/silverware, etc.). One such continuous motion style pot and pan washing machine is described in U.S. Pat. No. 4,773,436 issued to Cantrell et al., the entire disclosure of which is incorporated herein by reference. The machine of Cantrell includes a wash tank with multiple flow directional openings (e.g. jets, nozzles, etc.) evenly spaced apart at an elevated position along the rear wall of the wash tank. The tank is filled with fluid (i.e. water, detergent, etc.) to a level above the position of the flow directional openings. Pots and pans are placed in the wash tank, and a wash pump is activated to draw fluid from within the wash tank and direct it through the flow directional openings to create a jet stream. Each flow directional opening directs its jet stream toward the bottom wall of the wash tank, the bottom wall then deflects the jet stream upward and towards the front wall of the tank. The front wall then deflects the upward moving jet stream towards the rear wall of the tank, and the rear wall deflects the jet stream downward and back towards the front wall along the bottom wall. The combination of deflections of the jet stream from the bottom, front and rear walls provides a rolling washing action within the wash tank. Typically, the rolling wash action is continuous through the washing cycle of the machine, and wares are unloaded and loaded during the washing period as they are deemed clean by an operator of the machine. In this manner, multiple loads of wares are cleaned during a single washing period.

Although the prior art pot and pan washing machine disclosed in U.S. Pat. No. 4,773,436 provides an exceptional wash action, many of the components discussed above hinder the overall efficiency and performance of the machine. The inventions disclosed in U.S. application Ser. Nos. 09/947,484; 09/947,485; 10/744,666, and 12/781,750, the entire disclosures of which are incorporated herein by reference, provide components that greatly increase the overall efficiency and performance of the machine, including improvements to the intake and discharge manifolds, jets (flow directional openings), pump and system assembly methods. Notwithstanding, none of the prior art machines, systems or methods provide a simple and/or effective mechanism for filtering out and collecting debris in the form of solid and semi-solid particulate that can tend to accumulate in the wash fluid over time.

Debris is removed from the pots, pans and other utensils being cleaned in the wash basin/tank prior to being loaded into the wash basin/tank. Any debris that does not get removed becomes integrated with the fluid and fluid flow through the system in the form of solid and semi-solid particulate. Over time, as debris accumulates, it is unsightly, potentially reduces the effective cleaning power of the wash fluid and, eventually, could clog the system. Excessive amounts of this debris will ultimately cause the operator to use excessive time to keep the system clean. Excessive amounts of debris could arise from heavy and/or misuse of the system. While a process of periodically draining, cleaning/removing debris buildup, and refilling the wash basin is an adequate, expected and, at a certain point, required, solution, it would be beneficial to provide a system, and related methods that will reduce the frequency of downtime required for draining, cleaning, and refilling the wash basin and/or reduce the amount of unsightly debris within the wash fluid.

SUMMARY

The instant invention provides a system and methods of collecting solids (semi-solids or other particulate) from a washing machine wash tank in which a filtration opening is associated with an outlet side of a pump that circulates fluid within the washing machine wash tank. In preferred embodiments, a portion of the volume of fluid displaced by the pump is diverted by the opening through a particulate separation (or collection) device and returned to the wash tank after particulate within the fluid has been separated from the diverted portion of the fluid volume. The particulate is retained with the particulate separation (or collection) device as the fluid is returned to the wash tank via a discharge of the particulate separation (or collection) device. In some embodiments, the filtration opening will divert a substantial amount of fluid containing solid and/or semi-solid particulate debris from the fluid flow. In some embodiments, the opening comprises a fluid pump volute offshoot.

In preferred embodiments of the instant invention, the wash tank includes at least one flow directional opening associated with an outlet side of the pump for directing a jet stream of fluid into the wash tank from the pump. The wash tank further includes an intake manifold associated with the inlet side of the pump for withdrawing fluid from within the wash tank and into the pump.

In some embodiments, the separation or collection device of the instant invention returns the diverted portion of the volume of fluid displaced by the pump to the wash tank without requiring any force, additional pumping etc., other than the initial pumping force/step that diverted the fluid to the separation or collection device. In some such embodiments, the diverted portion of the volume of fluid displaced by the pump is returned to the wash tank from the separation or collection device via gravity.

In some embodiments, the particulate separation or collection device is configured to separate at least a substantial amount of any debris, soils, solid and/or semi-solid particulate from the diverted portion of the volume of displaced fluid. It will be appreciated that the particulate separation or collection device in some embodiments may not result in separations or collection of all particulates from the diverted portion of the fluid. It will further be appreciated that in some embodiments, particulate may remain in the portion of the displaced fluid volume that is not diverted to the particulate separation or collection device.

In some preferred embodiments, the pump comprises a centrifugal pump. In some such embodiments, the filtration opening is located within the housing of the pump, at an outer perimeter of the pressure side of a volute of the centrifugal pump. The centrifugal force acting on particulate within the fluid results in the particulate congregating toward the perimeter in generally higher concentrations than otherwise generally present within the volume of fluid displaced by the pump.

It will be appreciated that in some embodiments the filtration opening may be included at a location that is not within the pump housing, such as in the discharge of the pump and/or generally adjacent to the pump. In some such embodiments, the filtration opening is located at a position at the outlet side of the pump in which a generally higher concentration of particulate is present than is otherwise present within the volume of fluid displaced by said pump.

In some embodiments of the instant invention, the particulate separation or collection device is removably mounted within the diverted portion of the volume of the displaced fluid. In some such embodiments, the particulate separation or collection device is removably mounted to a wall of the wash tank. In some such embodiments, the particulate separation or collection device is removably mounted at least partially within a cavity formed in the wall of the wash tank. In some such embodiments, the particulate separation or collection device is capable of removal from the diverted portion of the displaced volume of fluid without requiring any adjustment to the flow of the diverted portion of fluid.

In some embodiments the particulate separation or collection device is located generally above the surface plane of fluid within the wash tank during normal operation of said washing machine. This allows the diverted portion of the fluid to be easily returned to the wash tank via gravity.

As a result of the fact that a portion of the displaced fluid is diverted into the separation or collection device, the remainder of the displaced fluid is allowed to circulate normally through the wash tank (e.g. through flow directional openings into the wash tank). Thus, in the event the separation or collection device becomes overloaded or clogged due to particulate build-up, the normal operation of the washing machine is not impacted. Furthermore, the separation or collection device may be removed for cleaning and/or reinserted into position during operation of the washing machine without any impact on the normal operation of the machine.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles of the present general inventive concept, is set forth in the accompanying description and is shown in the drawings and is particularly and distinctly pointed out and set forth in the appended claims.

FIG. 4-A is perspective view of the removable separation/collection device. FIG. 4-B is a partial detailed perspective view of the removable separation/collection device securely retained in the retention cavity formed in the backsplash of the wash tank.

FIG. 5-A is a detailed partial perspective view of the retention cavity with the removable separation/collection device removed. FIG. 5-B is a perspective view of the removable separation/collection device. FIG. 5-C is a partial perspective view of the removable separation/collection device securely retained in the retention cavity.

FIG. 6-A is a detailed perspective view, taken from area A of FIG. 6-C, of the removable separation/collection device securely retained in the retention cavity. FIG. 6-B is a perspective view of the removable separation/collection device. FIG. 6-C is a partial perspective view of the removable separation/collection device securely retained in the retention cavity.

DETAILED DESCRIPTION OF A PREFERRED EMBODIMENT

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1 through 6, an embodiment of the instant invention is discussed herein in connection with the pot and pan washing machine generally of the type disclosed in U.S. Pat. No. 4,773,436 (the entire disclosure of which is incorporated herein by reference). Nevertheless, it will be appreciated that the system and methods of the instant invention may be utilized in connection with pot and pan washing machines, such as those described in any of U.S. Pat. No. 4,773,436, or U.S. application Ser. Nos. 09/947,984, 09/947,484, 10/744,666, 12/781,750 and PCT/US09/59600 (the entire disclosures of which are incorporated herein by reference), as well as with any other washing machines, or various combinations of washing machine components now known or hereinafter developed without departing from the spirit and scope of the instant invention.

Figure 1:
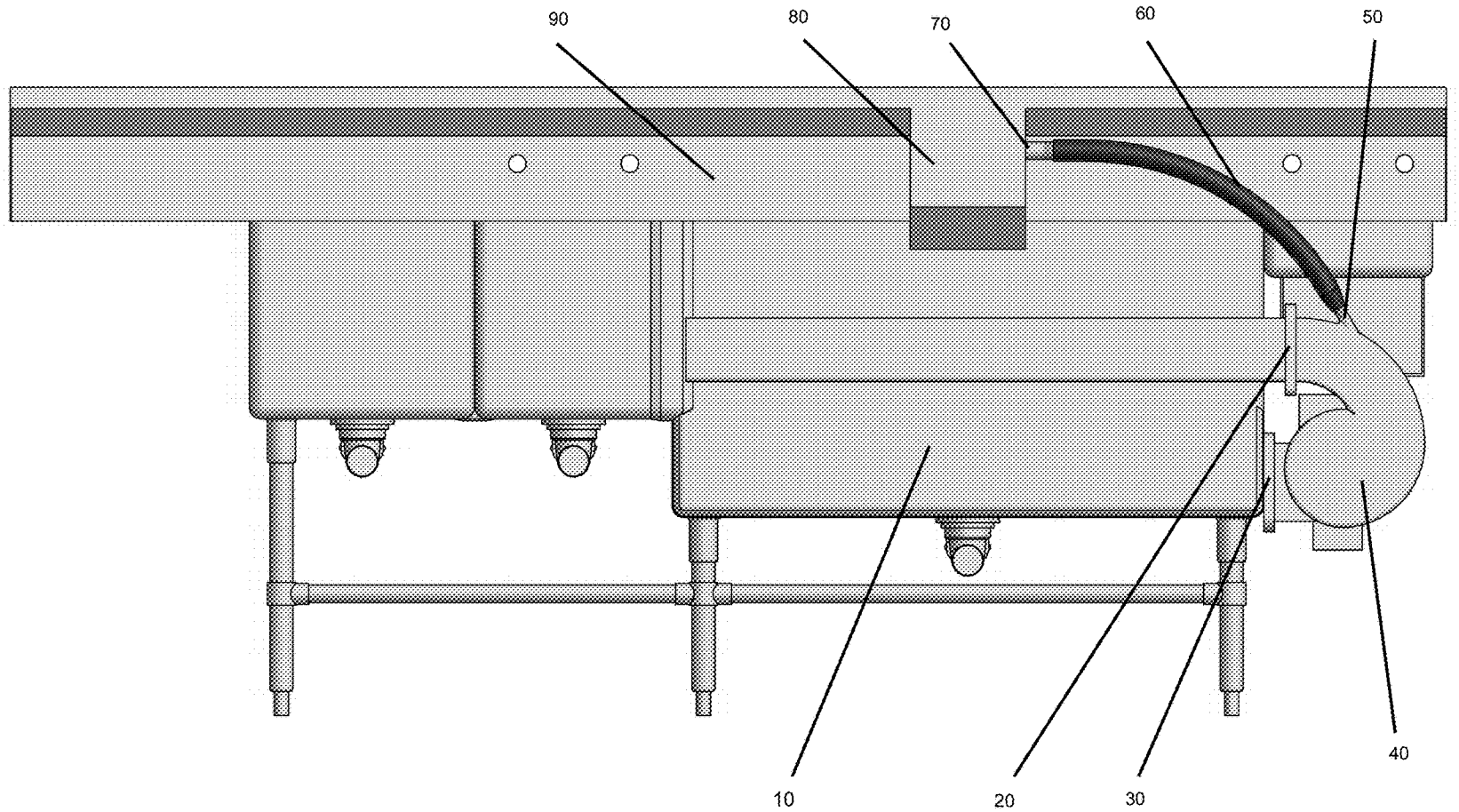
FIG. 1 is a rear view of a pot and pan washing machine of an embodiment of the instant invention.

FIG. 1 shows a rear elevation view pot and pan washing machine of an embodiment of the instant invention. In the embodiment of FIG. 1, the rear side of the pot and pan washing machine is shown. The Pump 40 is located to one side of the Wash Basin 10 (or wash tank). Rinse and sanitizing basins are located on the other side of the Wash Basin 10, directly opposing the Pump 40. The Pump 40 includes a Pump Intake 30 where wash fluid is drawn from the Wash Basin 10 into the inlet side of Pump 40 and a Pump Outlet 20 where wash fluid is discharged from the Pump 40 back into the Wash Basin 10 via nozzles, jets or other flow directional openings (shown in FIGS. 2 and 3) that are connected to the Pump 40 via an outlet manifold. The Pump 40 also includes a volute offshoot for diverting debris that is heavier than the wash fluid. Rather than exiting the Pump 40 via the Pump Outlet 20 along with the wash fluid, debris is diverted out of the normal wash fluid flow path and through a Debris Diversion Hose 60 via a Debris Outlet 50 to Pump 40. A Debris Collection Cavity 80 is located in the Backwall 90 (rear wall or side wall) of the Wash Basin 10 and positioned to receive debris from the Debris Diversion Hose 60 at a Debris Inlet 70 to Debris Collection Cavity 80. The debris exits the Debris Diversion Hose 60 at the Debris Inlet 70 and is collected in the Debris Collection Cavity 80. Preferably, a Debris Collection Receptacle 100 is located within the Debris Collection Cavity 80 such that the Debris Collection Receptacle 100 can be removed, emptied, and cleaned, without disrupting the fluid flow of the pot and pan washing machine.

The Pump 40 shown in FIG. 1, is a centrifugal pump that moves the wash fluid in a circular path through one or more volute(s) from the Pump Intake 30 to the Pump Outlet 20. The circular fluid flow path creates a centrifugal force that urges any heavier solid and/or semi-solid particulate waste outward from the center of the Pump 40. Centrifugal force guides the debris into the Debris Outlet 50, through the Debris Diversion Hose 60, out to the Debris Inlet 70 into the Debris Collection Cavity 80, and into the Debris Collection Receptacle 100 that is preferably situated within the Debris Collection Cavity 80. Fluid flows out or through the Debris Collection Receptacle 100 into the Wash Basin 10 while the debris stays within the Debris Collection Receptacle 100. It will be appreciated that although shown as solid, the walls of the Debris Collection Receptacle 100 may be porous or perforated to allow fluid to flow through without allowing solid debris to flow out of the Debris Collection Receptacle 100. In some embodiments, such as the embodiments shown, in which the side (front, and back or long walls) and end (short walls) walls of the Debris Collection Receptacle 100 are all shown as being solid, the bottom wall (not shown) is porous or perforated so allow fluid to flow through without allowing solid debris or other particulate to flow out of the Debris Collection Receptacle 100.

Figure 3:
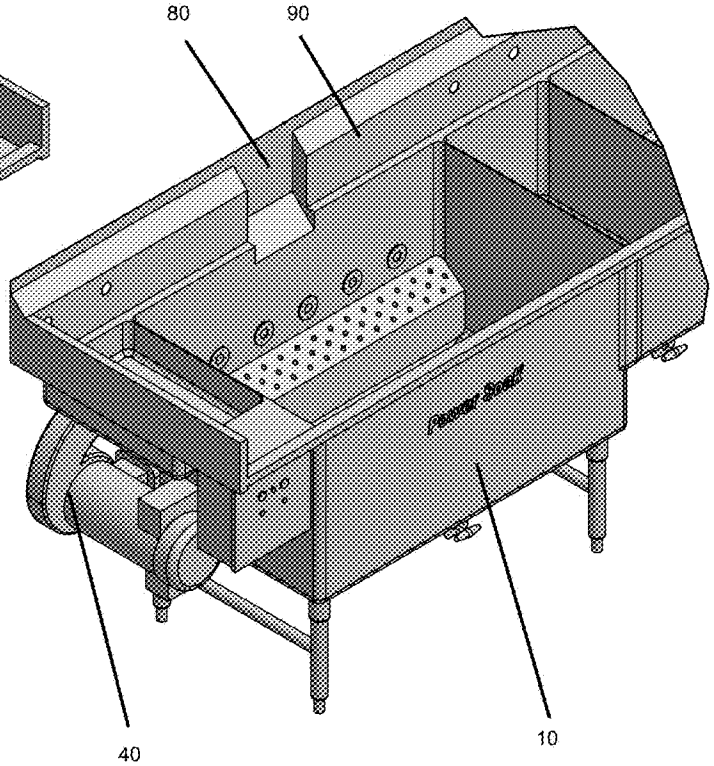
FIG. 3 is a partial perspective view of the pot and pan washing machine embodiment of FIG. 2, shown with the removable separation/collection device removed from a retention cavity in the backsplash portion of the rear (back) wall of the wash tank of the washing machine.
Figure 2:
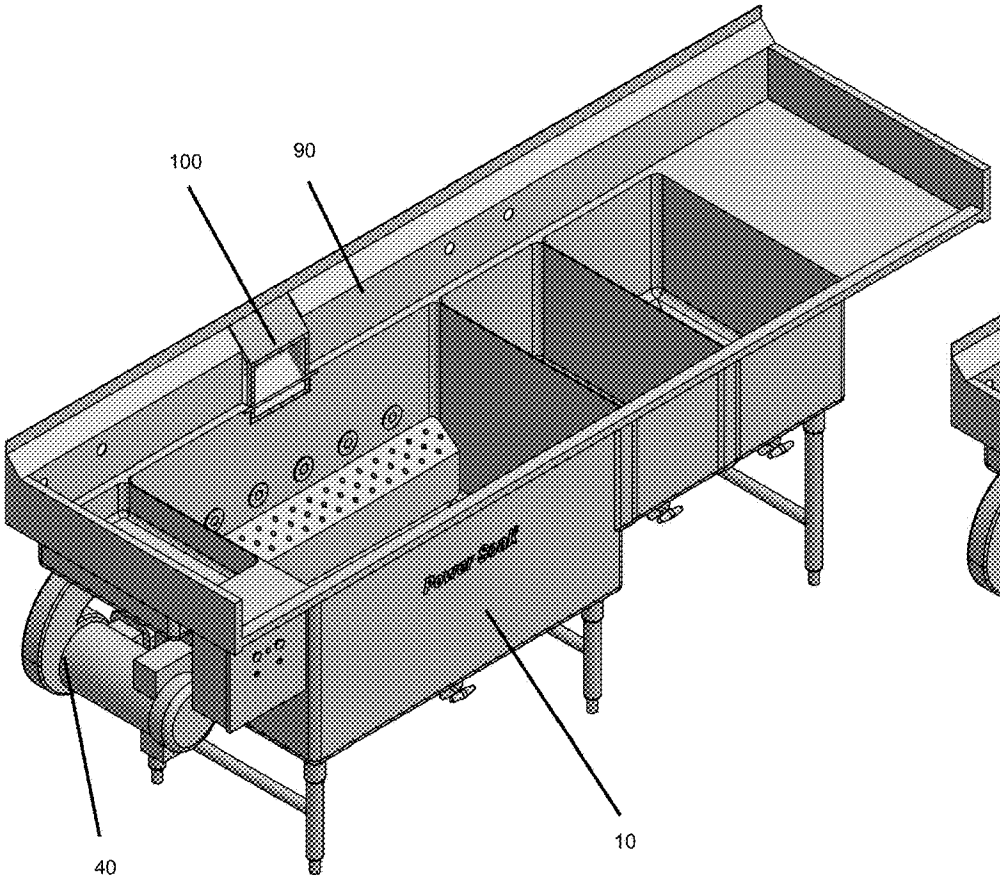
FIG. 2 is a perspective view of the pot and pan washing machine embodiment of FIG. 1, shown with a removable separation/collection device of an embodiment of the invention installed for particulate separation/collection and retention.

FIGS. 2 and 3 show perspective views of the pot and pan washing machine embodiment of FIG. 1, including several evenly spaced apart jets, an intake manifold, rinse tank and sanitizer tank. Although the Debris Outlet 50, Debris Diversion Hose 60, and Debris Inlet 70 are not visible in these perspective views, the Debris Collection Receptacle 100 is shown situated in the Debris Collection Cavity 80 in the Backwall (rear wall) 90 in FIG. 2. The Debris Collection Receptacle 100 has been removed in FIG. 3, to better show the Debris Collection Cavity 80 in the Backwall 90. FIGS. 1-3 show that, although the Debris Outlet 50, Debris Diversion Hose 60, and Debris Inlet 70 may not be easily accessible from the front and/or top of the pot and pan washing machine, the Debris Collection Cavity 80 and Debris Collection Receptacle 100 are easily accessible from the front and top, and are also located in a position within the machine that does not interfere with operation, loading and unloading of the machine.

Figures 4, 5, 6:
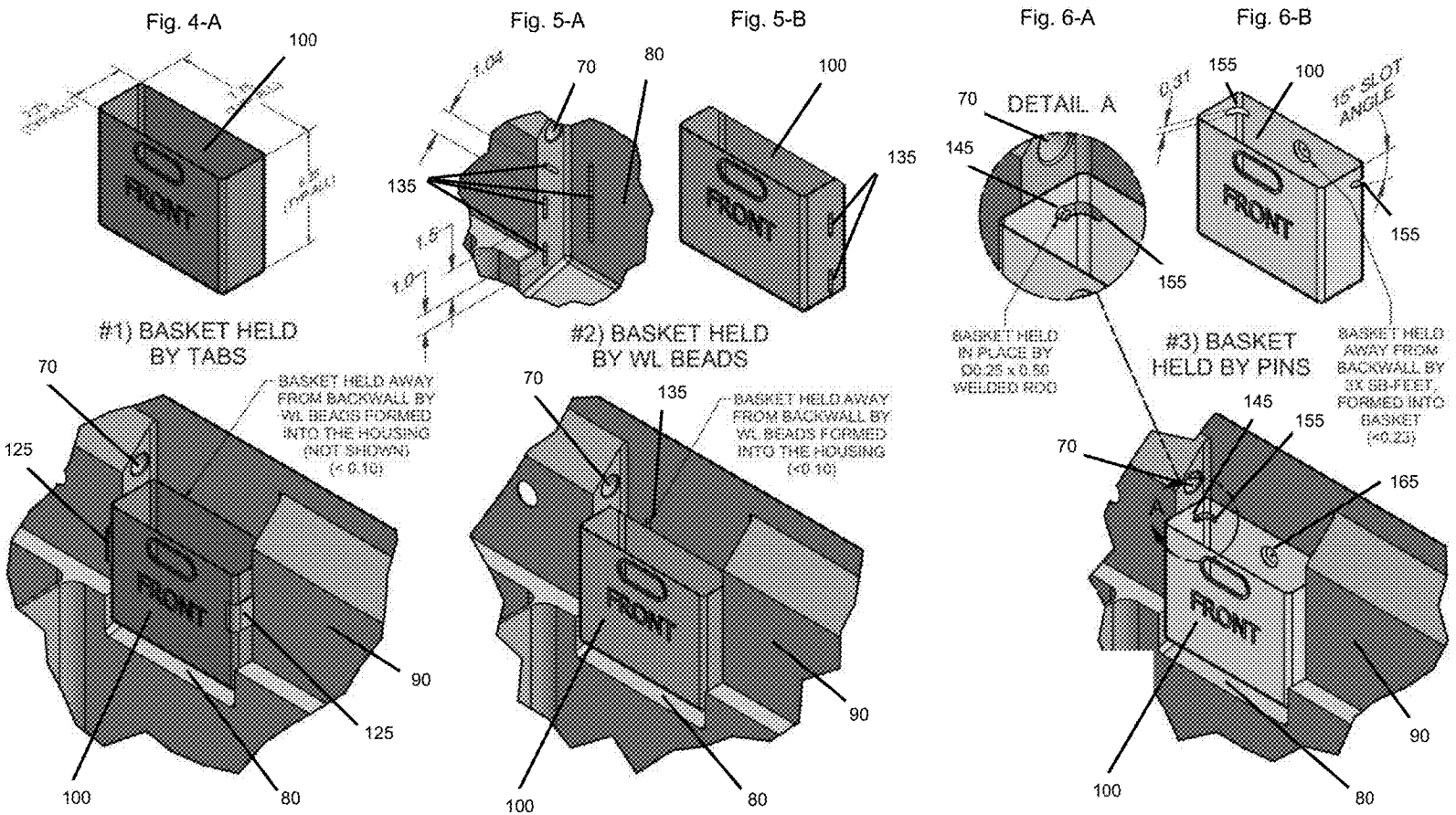
FIG. 4 includes detailed views of a first embodiment of the removable separation/collection device and retention cavity of FIGS. 2 and 3.
FIG. 5 includes detailed views of another embodiment of the removable separation/collection device and retention cavity of FIGS. 2 and 3.
FIG. 6 includes detailed view of another embodiment of the removable separation/collection device and retention cavity of FIGS. 2 and 3.

Referring to FIG. 4, an embodiment of the Debris Collection Receptacle 100 and associated Debris Collection Cavity 80 is shown. As shown in FIG. 4, the Debris Collection Receptacle 100 is a rectangular block in shape and includes four sidewalls/endwalls, an enclosed bottom, and an open top. In a preferred embodiment the bottom is porous or perforated to allow fluid to flow out of the bottom while retaining the particulate within the Debris Collection Receptacle 100. The Debris Collection Receptacle 100 shown in FIG. 4 also includes an opening toward the top of its front wall to allow fluid to flow out of the front while retaining particulate within the walls of the receptacle. One skilled in the art will appreciate that the Debris Collection Receptacle 100 may be sized and shaped in any manner, so long as it will fit in the Debris Collection Cavity 80 and will receive and store debris. The Debris Collection Receptacle 100 shown in FIG. 4 includes a handle (same as the opening discussed above) to aid in the removal and installation of the Debris Collection Receptacle 100 in the Debris Collection Cavity 80. The Debris Collection Receptacle 100 is shown removed from the Debris Collection Cavity 80 in FIG. 4-A. The Debris Collection Receptacle 100 is shown installed in the Debris Collection Cavity 80 in FIG. 4-B. Debris is discharged through the Debris Inlet 70, shown in the Backwall 90 in FIG. 4-B, into the Debris Collection Receptacle 100. As shown in FIG. 4-B, the Debris Collection Receptacle 100 is retained in the Debris Collection Cavity 80 by two Tabs 125 connected to the Backwall 90. The Tabs 125 are sized and shaped to substantially match the outer contours of the Debris Collection Receptacle 100 to receive it and securely retain it in place in the Debris Collection Cavity 80. The Debris Collection Receptacle 100 also includes one or more bead welds or other protrusions 135 on the rear side to create a gap between the Debris Collection Receptacle 100 and the Backwall 90.

Referring to FIG. 5, another embodiment of the Debris Collection Receptacle 100 and associated Debris Collection Cavity is shown. As before, the Debris Collection Receptacle 100 is a rectangular block in shape and includes four sidewalls/endwalls, an enclosed bottom, and an open top. In a preferred embodiment the bottom is porous or perforated to allow fluid to flow out of the bottom while retaining the particulate within the Debris Collection Receptacle 100. The Debris Collection Receptacle 100 shown in FIG. 5 also includes an opening toward the top of its front wall to allow fluid to flow out of the front while retaining particulate within the walls of the receptacle. The Debris Collection Receptacle 100 is sized and shaped to fit in the Debris Collection Cavity 80 and to receive and store debris. The Debris Collection Receptacle 100 shown in FIG. 5 also includes a handle to aid in the removal and installation of the Debris Collection Receptacle 100 in the Debris Collection Cavity 80. FIG. 5-A is a perspective view of a portion of the Debris Collection Cavity 80 with the Debris Collection Receptacle 100 removed. The Debris Collection Receptacle 100 is shown removed from the Debris Collection Cavity 80 in FIG. 5-B. In FIG. 5-C, the Debris Collection Receptacle 100 is securely retained in the Debris Collection Cavity 80. As shown in FIG. 5, the Debris Collection Receptacle 100 includes a plurality of bead welds or other protrusions 135.

Beads 135 are located on the Backwall 90 in the Debris Collection Cavity 80, as shown in FIG. 5-A, and additional beads 135 are located on the Debris Collection Receptacle 100, as shown in FIG. 5-B. The beads 135 are sized and shaped in mating contours such that the Debris Collection Receptacle 100 is securely retained in the Debris Collection Cavity 80. Debris is discharged through the Debris Inlet 70, shown in the Backwall 90 in FIG. 5-C, and received and stored in the Debris Collection Receptacle 100. The Backwall 90 of the Debris Collection Cavity 80 also includes one or more beads 135 to create a gap between the Debris Collection Receptacle 100 and the Backwall 90. One skilled in the art will readily recognize that beads 135 may be located on the back of the Debris Collection Receptacle 100 (FIG. 4), on the Backwall 90 of the Debris Collection Cavity 80 (FIG. 5), or both, without departing from the scope of the present general inventive concept.

Referring to FIG. 6, another embodiment of the Debris Collection Receptacle 100 and associated Debris Collection Cavity 80 is shown. As before, the Debris Collection Receptacle 100 is a rectangular block in shape and includes four sidewalls/endwalls, an enclosed bottom, and an open top. In a preferred embodiment the bottom is porous or perforated to allow fluid to flow out of the bottom while retaining the particulate within the Debris Collection Receptacle 100. The Debris Collection Receptacle 100 shown in FIG. 6 also includes an opening toward the top of its front wall to allow fluid to flow out of the front while retaining particulate within the walls of the receptacle. The Debris Collection Receptacle 100 is sized and shaped to fit in the Debris Collection Cavity 80 and to receive and store debris. The Debris Collection Receptacle 100 shown in FIG. 6 also includes a handle to aid in the removal and installation of the Debris Collection Receptacle 100 in the Debris Collection Cavity 80. FIG. 6-A is a detail view of a portion of the Debris Collection Receptacle 100 held in place in the Debris Collection Cavity 80 by a Pin 145 and Slot 155. The Debris Collection Receptacle 100 is shown removed from the Debris Collection Cavity 80 in FIG. 6-B. In FIG. 6-C, the Debris Collection Receptacle 100 is securely retained in the Debris Collection Cavity 80 by Pins 145 and Slots 155. As shown in FIG. 6-C, and in greater detail in FIG. 6-A, in the Debris Collection Cavity 80, the Backwall 90 includes a plurality of Pins 145. The Debris Collection Receptacle 100 includes a plurality of Slots 155 sized and shaped to receive the Pins 145 and preferably angled so as to securely retain the Debris Collection Receptacle 100 in place in the Debris Collection Cavity 80. Debris is discharged through the Debris Inlet 70, shown in the Backwall 90 in FIGS. 6-A and 6-C, and received and stored in the Debris Collection Receptacle 100. In the embodiment shown in FIG. 6, the Debris Collection Receptacle 100 includes one or more protrusion or Foot 165 to create a gap between the sidewall of the Debris Collection Receptacle 100 and the Backwall 90.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A washing machine comprising:

a wash tank for holding a volume of fluid;

a pump for circulating the volume of fluid within said wash tank, said pump being configured to cause a stream of fluid to flow through said pump;

at least one flow directional opening associated with an outlet side of said pump, said flow directional opening being configured to direct a first portion of the stream of fluid into said wash tank;

an intake manifold associated with an inlet side of said pump, said intake manifold being configured to allow fluid to be withdrawn from the volume of fluid within said wash tank, thereby allowing the volume of fluid to serve as a source for the stream of fluid; and a filtration opening associated with said outlet side of said pump, said filtration opening being configured to divert a second portion of the stream of fluid towards a receptacle, wherein said receptacle is configured to separate particulates from the fluid, thereby filtering the fluid, and wherein the washing machine is configured such that the filtered fluid flows out of a bottom portion of the receptacle prior to flowing back to the volume of fluid in said wash tank.

2. The washing machine as claimed in claim 1, wherein said receptacle is displaced vertically upwards and away from a top surface of the volume of fluid within said wash tank.

3. The washing machine as claimed in claim 1, wherein said receptacle is configured to separate at least a substantial amount of any debris, soils, solid and/or semi-solid particulate from said collected fluid.

4. The washing machine as claimed in claim 1, wherein said pump comprises a centrifugal pump that is configured to generate a centrifugal force that acts on particulates within said fluid.

5. The washing machine as claimed in claim 4, wherein said filtration opening is located within a housing of said pump.

6. The washing machine as claimed in claim 5, wherein said filtration opening is located at an outer perimeter of a pressure side of a volute of said pump.

7. The washing machine as claimed in claim 6, further comprising a debris outlet extending from said filtration opening, wherein said debris outlet extends away from said pump at an angle approximately half-way between a first angle and a second angle wherein said first angle is approximately in line with the fluid flow direction at the filtration opening and the second angle is approximately normal to the fluid flow direction at the filtration opening.

8. The washing machine as claimed in claim 1, wherein a user is able to remove particulates from the receptacle during normal operation of the washing machine.

9. The washing machine as claimed in claim 1, wherein said pump is configured such that particulates present within said volume of fluid displaced by said pump are urged towards said filtration opening.

10. The washing machine as claimed in claim 9, wherein said filtration opening is located within a housing of said pump.

11. The washing machine as claimed in claim 9, wherein said filtration opening is located adjacent to said pump.

12. The washing machine as claimed in claim 9, wherein said receptacle is located above the surface plane of fluid within said wash tank during normal operation of said washing machine.

13. The washing machine as claimed in claim 1, wherein said receptacle is moveable during normal washing operations to and from a first position, said receptacle being configured to receive at least part of the second portion of the stream of fluid when said receptacle is in the first position.

14. The washing machine as claimed in claim 13, wherein the washing machine is configured such that moving said receptacle to and from said first position does not require any adjustment to the flow of the second portion of the stream of fluid during such movement.

15. The washing machine as claimed in claim 13, wherein said receptacle is configured so as to be removably mounted to a side wall of said wash tank when said receptacle is in the first position.

16. The washing machine as claimed in claim 15, wherein said receptacle is least partially within a cavity formed in said side wall of said wash tank when said receptacle is in the first position.

17. The washing machine as claimed in claim 1, wherein said wash tank is generally rectangular and includes a bottom wall, two side walls and two end walls extending upwardly from said bottom wall, said side walls being longer than said end walls.

18. The washing machine as claimed in claim 1, wherein said receptacle includes a bottom panel and vertical panels extending vertically upward from said bottom panel so as to define an interior area, at least part of the second portion of the fluid stream being directed into said interior area of said receptacle.

19. The washing machine as claimed in claim 18, wherein said bottom panel of said receptacle defines a plurality of apertures, said plurality of apertures being configured to allow fluid to flow down through said apertures while preventing particulates in the fluid from flowing through said apertures, thereby filtering the fluid.

20. A washing machine comprising:

a wash tank for holding a volume of fluid;

a pump for circulating the volume of fluid within said wash tank, said pump being configured to cause a stream of fluid to flow through said pump;

at least one flow directional opening associated with an outlet side of said pump, said flow directional opening being configured to direct a first portion of the stream of fluid into said wash tank;

an intake manifold associated with an inlet side of said pump, said intake manifold being configured to allow fluid to be withdrawn from the volume of fluid within said wash tank, thereby allowing the volume of fluid to serve as a source for the stream of fluid; and a filtration opening associated with said outlet side of said pump, said filtration opening being configured to divert a second portion of the stream of fluid towards a receptacle, wherein said receptacle is configured to separate particulates from the fluid, thereby filtering the fluid, and wherein a user is able to remove particulates from the receptacle during normal operation of the washing machine.

21. A method of removing particulate from fluid in a washing machine:

the washing machine comprising:

a wash tank for holding the volume of fluid;

a pump for circulating the volume of fluid within the wash tank, the pump being configured to cause a stream of fluid to flow through the pump;

at least one flow directional opening associated with an outlet side of the pump, the flow directional opening being configured to direct a first portion of the stream of fluid into the wash tank;

an intake manifold associated with an inlet side of the pump, the intake manifold being configured to allow fluid to be withdrawn from the volume of fluid within the wash tank, thereby allowing the volume of fluid to serve as a source for the stream of fluid; and a filtration opening associated with the outlet side of the pump, the filtration opening being configured to divert a second portion of the stream of fluid towards a receptacle, wherein the receptacle is configured to separate particulates from the fluid, thereby filtering the fluid, and wherein the washing machine is configured such that the filtered fluid flows out of a bottom portion of the receptacle prior to flowing back to the volume of fluid in the wash tank;

the method comprising:

guiding the second portion of the stream of fluid to the receptacle when the receptacle is in a first position;

separating particulate from the second portion of the stream of fluid; and allowing the second portion of the stream of fluid to flow out of a bottom portion of the receptacle and back into the main volume of fluid in the wash tank.

22. The method as claimed in claim 21, wherein the second portion of the stream of fluid includes a generally higher concentration of particulate than is otherwise present within the stream of fluid.

23. The method as claimed in claim 21, wherein allowing the second portion of the stream of fluid to flow back into the main volume of fluid in the wash tank requires no additional pumping step.

24. The method as claimed in claim 21, wherein a user is able to remove particulates from the receptacle during normal operation of the washing machine by removing the receptacle from the first position without having to adjust the flow of the stream of fluid.

* * * * *